United States Patent [19]

Miles

[11] 4,362,423

[45] Dec. 7, 1982

[54] COUPLING FOR COIL-THREAD REBAR

[75] Inventor: Wendell J. Miles, Grand Haven, Mich.

[73] Assignee: Williams Form Engineering Corporation, Grand Rapids, Mich.

[21] Appl. No.: 184,897

[22] Filed: Sep. 8, 1980

[51] Int. Cl.[3] ..... B25G 3/36; E04G 7/00

[52] U.S. Cl. ..... 403/393; 403/391; 403/311; 403/364

[58] Field of Search ..... 403/393, 310, 311, 284, 403/391, 389, 14, 364

[56] References Cited

U.S. PATENT DOCUMENTS

| | | | |
|---|---|---|---|
| 1,419,741 | 6/1922 | Lee | 403/393 |
| 2,067,271 | 1/1937 | Johnson et al. | 403/310 |
| 2,983,012 | 5/1961 | Madden | 403/393 |

*Primary Examiner*—Wayne L. Shedd

*Attorney, Agent, or Firm*—Glenn B. Morse

[57] ABSTRACT

This coupling device locks together overlapped lengths of coil-thread rebar by positively interengaging segments of the device with the threading of the respective rebar rods, and positively interengaging the segments themselves for alignment, and to complete the stress transfer.

5 Claims, 5 Drawing Figures

COUPLING FOR COIL-THREAD REBAR

BACKGROUND OF THE INVENTION

A need for securing overlapped rods together occurs in many different types of situations. Where the surfaces of the rods are fairly smooth, the securing can be done by welding, or by a variety of clamping devices that generate a jamming from the effect of wedges. U.S. Pat. Nos. 3,079,186 and 3,437,361 are illustrative of this type of device. Where the overlap portions of the rod have the usual threading common to bolts and nuts, devices are available for transferring tension through the rod overlap by maintaining the interengagement of the two adjacent thread systems. U.S. Pat. No. 3,039,800 is of this type, and U.S. Pat. No. 3,065,010 engages not only the threading of the rods, but also engages that of rods with the internal threading of a surrounding ring. Both of these patents are based upon conventional machine threading that permits positive interengagement of the threads such that when once interengaged, there is no relative axial freedom of movement of the rods with respect to each other.

Where the rods have surface irregularities according to a pattern substantially different from conventional machine threading, it still may be practical to interengage the surface irregularities for at least a participation in the transfer of tension across the overlap area. This form of rod configuration is frequently encountered in so-called "rebar", which is the reinforcing rod commonly embedded in concrete. A transverse clamping action is often sufficient to provide a satisfactory connection between rod sections, with the clamping serving both to hold the surface irregularities in engagement, and to positively interengage with these irregularities to transfer at least some of the axial stress. U.S. Pat. Nos. 3,771,884 and 4,080,084 are illustrative of this type of device. One form of rebar bears a somewhat superficial similarity to rod material that has machine threading. Where the latter has a V-shaped cross-section providing positive interengagement, the helical pattern of the rebar has a characteristic semi-circular cross-section that eliminates a corresponding positive interlock. The present invention is directed at providing a splicing device for this form of rebar.

SUMMARY OF THE INVENTION

A pair of similar segments of a splicing device has internal surfaces configured to positively interengage with the surface helical pattern of both of a pair of overlapped rods. These segments also have laterally interengaging projection-recess areas. The segments are held together in full interengagement with each other, and with the rods, by a surrounding sleeve that is axially shoved into position.

DESCRIPTION OF THE PREFERRED EMBODIMENT

Figure 1:
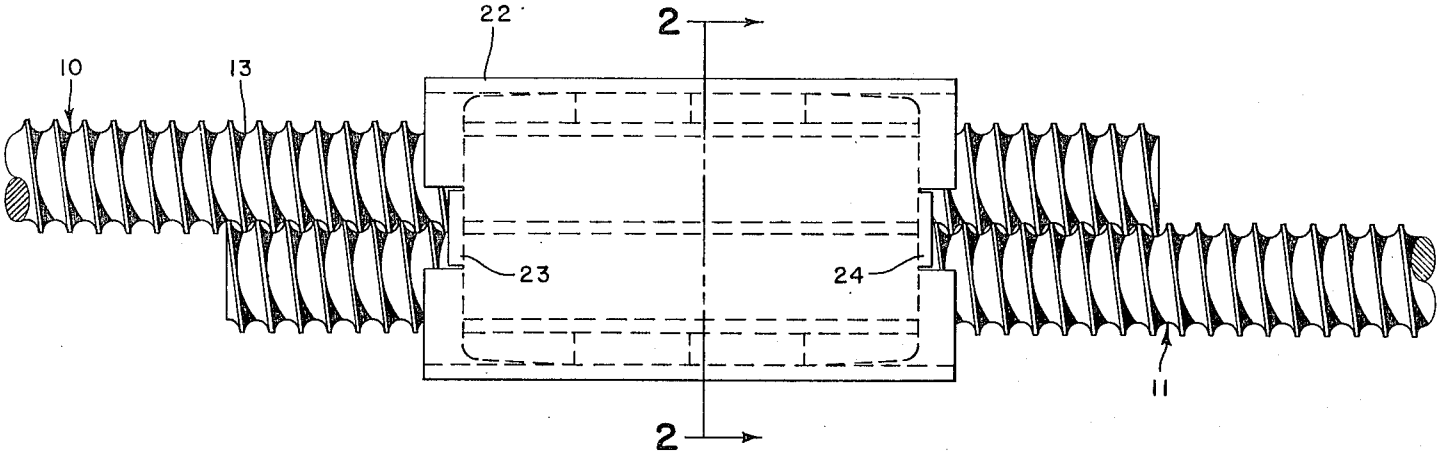
FIG. 1 is a side view showing overlapped lengths of helical-surface rebar secured together by a complete clamping device embodying the present invention.
Figure 2:
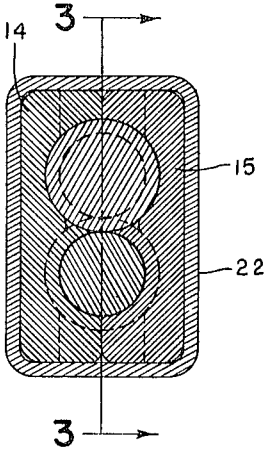
FIG. 2 is a section on the plane 2—2 of FIG. 1.

Referring to the drawings, the lengths of rebar indicated at 10 and 11 each have a helical threaded configuration occupying the entire peripheral surface. Viewed from the side, the thread pattern responsible for this surface configuration has a generally semi-circular cross-section, as indicated at 13 in FIG. 1. It is obvious that the thread systems of the two rods do not positively interengage when brought laterally together in the sense that the V-shaped configuration of machine threading would provide. In the present invention, the two rods are placed into position where the threads do interengage, but this close proximity of the rods is primarily to minimize the distance apart of the axes of the rods to correspondingly minimize the rotational moment generated when tension is applied across the coupled lengths of the rod sections. In other words, stress is not transferred directly from one rod threading to the other. All of the transferred stress proceeds via the clamping device itself.

Figure 3:
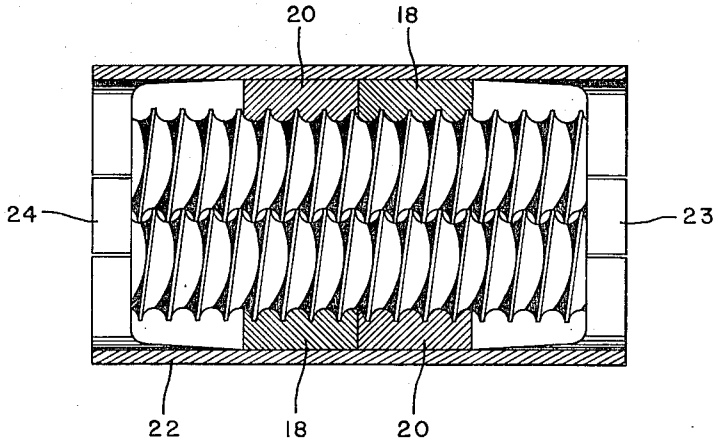
FIG. 3 is a section on the plane 3—3 of FIG. 2, prior to the deformation of the locking tabs.
Figure 4:
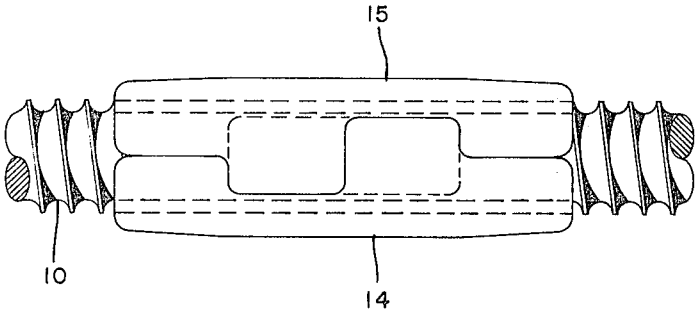
FIG. 4 is a top view showing the interengaged clamping segments in the absence of the surrounding sleeve.
Figure 5:
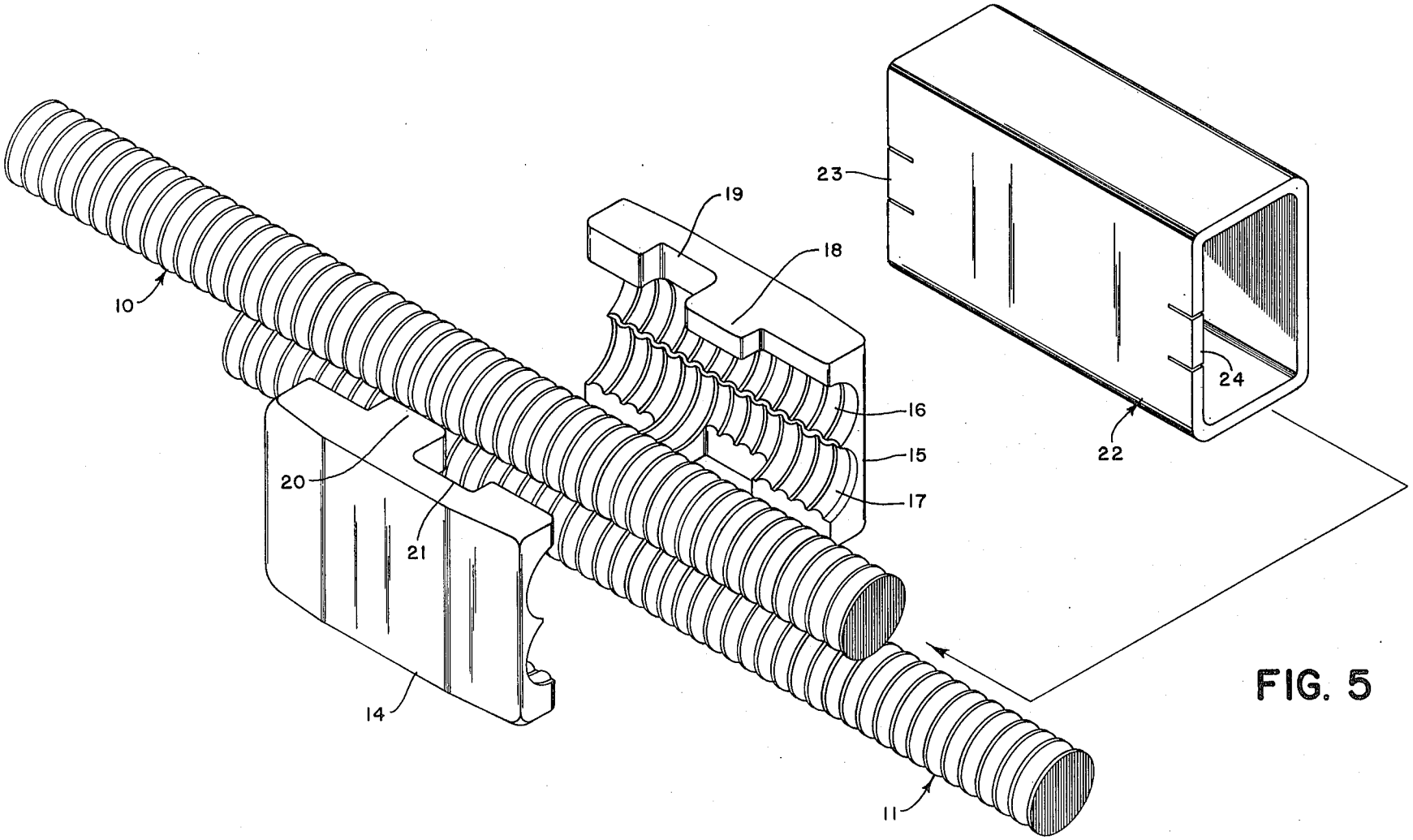
FIG. 5 is an exploded perspective view showing the components of the splice shown in FIG. 1.

Referring particularly to FIG. 5, the clamping device centers in the similar segments 14 and 15. These have the same configuration, and one of these segments is simply switched end for end with respect to the other. Each of the sections has a portion of its internal surface formed to exactly mate with the surface threading of each of the rods, the segment 15 having the portion 16 for receiving the rod 10 and the portion 17 for receiving the rod 11. In addition, each of the segments has a projection 18 and a recess 19 on one side, and an oppositely-located projection 20 and recess 21 along the opposite side. When switched end for end, as shown in FIG. 5, these projections and recesses form a laterally-engaging interlock that assures that the two segments will properly interengage with the threading of the overlapped rods. Any imbalance of loading from the transfer of the tension stresses from the rods directly through each of the segments from one rod to the other will also be prevented by the lateral interlock of the projections and recesses. The fully interengaged position of the segments shown in FIG. 4 is maintained by slipping the surrounding sleeve 22 into the position shown in FIG. 3. The sleeve is, of course, first slipped on over the end of one of the rods before the segments 14 and 15 are laterally brought together. The sleeve is provided with tabs as shown at 23 and 24 which may be hammered down to the position shown in FIG. 1 after the unit has been fully assembled, in order to prevent accidental displacement of the sleeve which would fully or partially free the segments from the engaged position. The slight taper appearing in the axially opposite ends of the segments is for the purpose of facilitating the assembly of the sleeve into position. The sleeve should provide a fairly snug fit, and would normally be tapped into place with a hammer.

I claim:

1. In combination with a pair of overlapped rods each having a regular pattern of protrusions and indentations on the side surfaces thereof, a coupling device comprising:

a pair of blocks each having substantially parallel grooves for laterally receiving overlapped portions of said rods, said grooves having surfaces providing a mating configuration to the surfaces of said rods establishing an interlock between said rods and blocks for transfer of axial forces from one of said rods to the other thereof, said blocks having laterally interengaging portions for alignment of said blocks with respect to each other; and a sleeve adapted to fit closely around the assembly of said rods and blocks to hold said blocks in engagement with said rods.

2. A combination as defined in claim 1, wherein said blocks are identical.

3. A combination as defined in claim 1, wherein said grooves position said rods for interengagement of said rod protrusions and indentations.

4. A combination as defined in claim 1, wherein said sleeve is a tubular member adapted to axially interengage and surround said assembly.

5. A combination as defined in claim 4, wherein said sleeve is provided with at least one deformable tab capable of being bent to form an abutment limiting axial movement of said sleeve with respect to said assembly.

* * * * *